US005865057A

United States Patent [19]

Nakano et al.

[11] Patent Number: 5,865,057

[45] Date of Patent: Feb. 2, 1999

[54] WORK TRANSFER IN MULTI-STAGE FORGING APPARATUS

[75] Inventors: Takayuki Nakano; Takayuki Tanaka, both of Kyoto, Japan

[73] Assignee: Kabushi Kaisha Sakamura Kikai Seisakusho, Osaka, Japan

[21] Appl. No.: 963,270

[22] Filed: Nov. 3, 1997

[30] Foreign Application Priority Data

Nov. 11, 1996 [JP] Japan ..... 8-012106

[51] Int. Cl.[6] ..... B21J 13/10

[52] U.S. Cl. ..... 72/361; 72/405.16

[58] Field of Search ..... 72/361, 405.12, 72/405.16; 470/154, 177, 178

[56] References Cited

FOREIGN PATENT DOCUMENTS 57-48294 10/1982 Japan .
42358 11/1990 Japan .
2502039 4/1996 Japan .
2521911 10/1996 Japan .
2550237 6/1997 Japan .

*Primary Examiner*—Lowell A.. Larson
*Attorney, Agent, or Firm*—Barnes & Thornburg

[57] ABSTRACT

The invention provides a work transfer in a multi-stage forging apparatus for stepwise forging a work into a refined product.

The work transfer has an open-close type chuck which is, with its pair of finger members, suitable for grasping such a work whose diameter at its midportion is smaller than that at its endportions.

The work transfer is, in addition to the chuck open-close mechanism, provided with the chuck approach-recede mechanism for a work extract-insert function, which moves the chuck so that the finger members of the chuck may approach to and recede from a front face of a die.

The work transfer comprises a single camshaft rotating synchronously with a forging motion, and both the chuck open-close mechanism and the chuck approach-recede mechanism are operated by the single rotation of the camshaft.

3 Claims, 15 Drawing Sheets

WORK TRANSFER IN MULTI-STAGE FORGING APPARATUS

FIELD OF THE INVENTION

The present invention relates to a work transfer provided in a multi-stage forging apparatus for stepwise forging a work from a raw material of a rough shape into a finished product of a refined shape, and more particularly to a work transfer having a plurality of chucks for successively transferring the work throughout forging stations each provided with a die and a punch.

BACKGROUND OF THE INVENTION

A multi-stage forging apparatus fabricating various component parts like bolts, nuts, etc. has a base frame and stepwise forges a work being fed at one side end portion of the base frame as a raw material having a rough shape into a finished product having a refined shape throughout a plurality of forging stations each provided with a die and a punch. The work is forged at respective forging station and pushed out of the die of each station by means of a knockout pin installed in each die. The forging apparatus is further provided with a work transfer having a plurality of chucks for grasping and transferring the works from one forging station to subsequent other forging station.

Conventionally, the work transfer has a chuck reciprocating mechanism for transferring the work between the adjacent dies, and in an operation of the chuck reciprocating mechanism, the chuck reciprocates in a single direction in which the dies are aligned, i.e., after grasping the work in front of an upstream did the chuck moves to a front of a downstream die, and then, after releasing the work there it returnes to the front of the upstream die.

On the other hand, in case of forging such a specific work, a housing of an ignition plug, for instance, that a length of the work is relatively short and a diameter of the work becomes smaller as it goes to a rear end portion thereof, when the work is so pushed out from a bore of the die that most part of it comes out of the die, the work is likely to be tilted relative to the die with its head down under gravity. Therefore, it is possible that the chuck of the work transfer may fail to grasp the work, and even if the work is grasped, since it is not in a correct horizontal posture but tilted the work may not be driven into a bore at the next die properly or smoothly by only the forging motion of the punch.

To avoid this disadvantage, Japanese Examined Patent Publication No. 48294/1982 or Japanese Examined Utility Model Patent Publication No. 42358/1990 discloses a work transfer having a work extract-insert function relative to the die, which is operated as follows:

A chuck of the work transfer grasps the work of such specific shape as mentioned above at a time that the work is not wholly pushed out of the upstream die by the knockout pin, and the chuck recedes from a front face of the upstream die keeping the grasp of the work. Then, the chuck moves to the front of the downstream die, and approaches to a front face of the downstream die keeping the grasp of the work. Therefore, the work is, at the upstream die, extracted from the die bore by the chuck before it is tilted, and, at the downstream die, the work is inserted into the die bore to some extent by the chuck before it is fully driven into the die bore by the forging motion of the punch.

However, the chuck employed in the work transfer disclosed in the above-mentioned Publications is a press type chuck that has a pair of finger members arranged to face each other leaving a predetermined spacing therebetween, and the work is pushed out of the die and pressed into the spacing between the finger members so that it should be grasped by the finger members at its portion where a diameter is larger than a breadth of the spacing.

Therefore, in case of forging and grasping still such a specific a work, a bottom plate Z for a speaker as shown in FIG. 15, for instance, that has a stepped surface, diameter of each stepped portion being different and becoming smaller as it goes to a rear end portion thereof, and the work has a thin flange X1 of bigger diameter at its front portion, a relatively longer tubular midportion X2 of smaller diameter and a relatively shorter tubular rear portion X3 of still further smaller diameter, it is possible that the press type chuck as mentioned above may not grasp the work stably because the front flange portion X1 of the work is too thin for the chuck to catch steadily while the chuck is to grasp the work at that flange portion X1. As a result, it is inevitable that the chuck should grasp the work Z at the longer midportion X2 instead of the thin front flange portion X1, but above-mentioned press type chuck is, as clearly understood, not structurally able to comply with this desire.

In order to overcome this problem, as also disclosed in the above Japanese Examined Utility Model Patent Publication No. 42358/1990, an open-close type chuck may be employed, in which the finger members are swingably supported respectively so as to open for releasing the work and to close for grasping the work. However, in order to employ this open-close type chuck, in addition to the chuck reciprocating mechanism for the work transfer function and to the chuck approach-recede mechanism for the work extract-insert function, another chuck open-close mechanism for the work grasp-release function is required, which extremely complicates a whole structure of the work transfer.

SUMMARY OF THE INVENTION

Consequently, the present invention was devised to overcome the aforementioned problems, and one objective of the invention is to provide a work transfer in a multi-stage forging apparatus for stepwise forging a work throughout a plurality of forging stations so that the work is progressively refined, the work transfer being provided with the open-close type chucks able to easily grasp a midportion of a work, a diameter of the midportion is smaller than that of endportions, as well as the work transfer being so functioned as can extract and insert the work relative to the die of the forging station without complicating a whole structure of the work transfer.

According to the invention, the work transfer is provided with both the chuck open-close mechanism for opening and closing the finger members of the chuck and the chuck approach-recede mechanism to move the chuck so that the chuck may approach to and recede from the front face of the die for the work extract-insert function. The chuck open-close mechanism is operated by a rotation of a camshaft which rotates synchronously with the forging motion of the ram, and the chuck approach-recede mechanism is also operated by the same rotation of the camshaft, using an associattransmission mechanism, whereby a complicacy of whole structure of the work transfer is suppressed.

According to another aspect of the invention, the chuck approach-recede mechanism is operated by an expand-contract motion of a piston of a cylinder, while the chuck open-close mechanism is operated by the rotation of the camshaft, whereby the associat transmission mechanism may be omitted, and thus, a complicacy of whole structure of the work transfer is further suppressed.

The above and other objects, features and advantages of the present invention will be apparent from the following detailed description of the preferred embodiments of the invention in conjunction with the accompanying drawings.

DETAILED DESCRIPTION OF THE PREFERRED EMBODIMENT

The present invention will now be described by way of preferred embodiments referring to the accompanying drawings.

Figure 1:
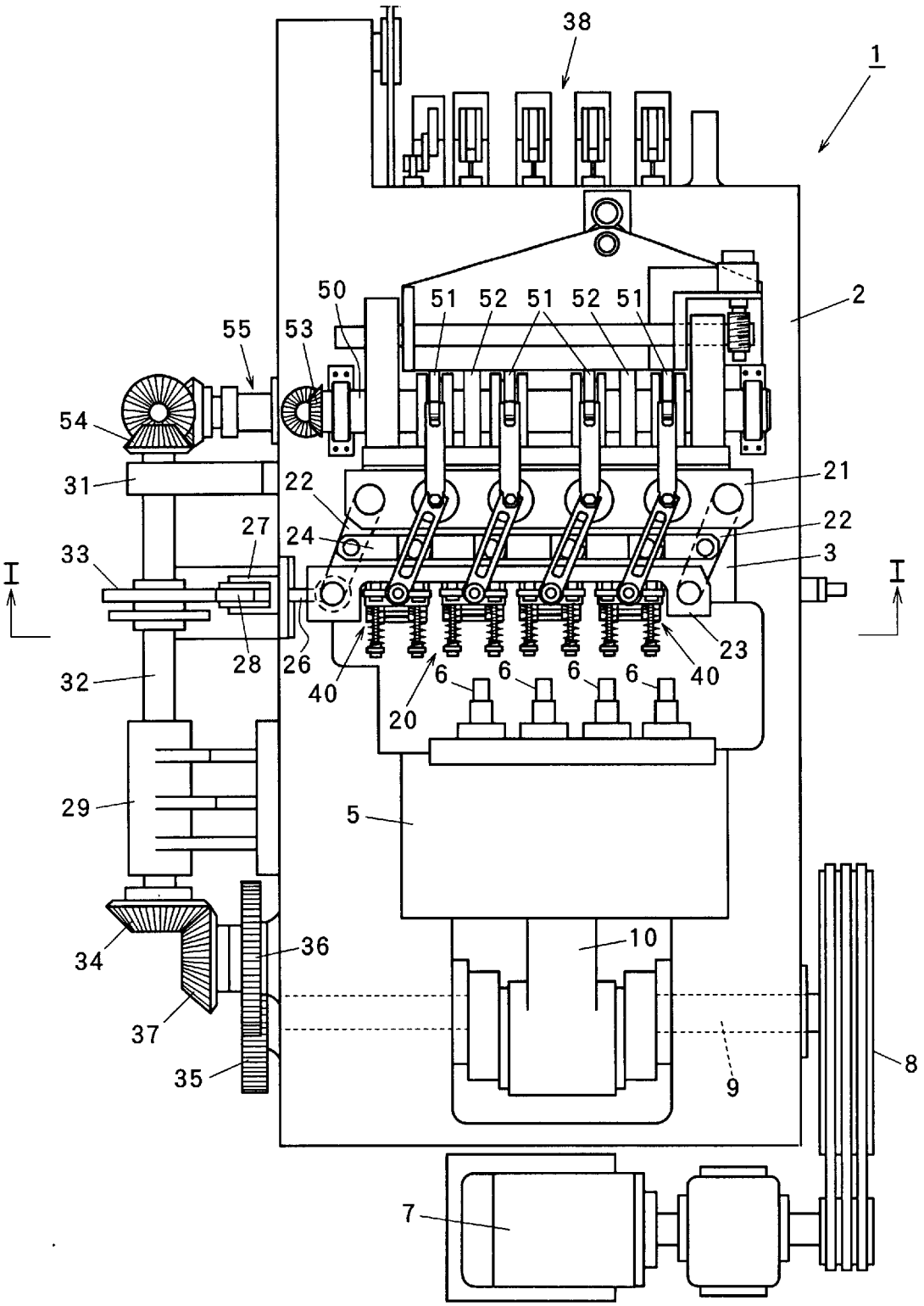
FIG. 1 is a schematic plan view of a multi-stage forging apparatus provided with a work transfer according to an embodiment of the invention.
Figure 2:
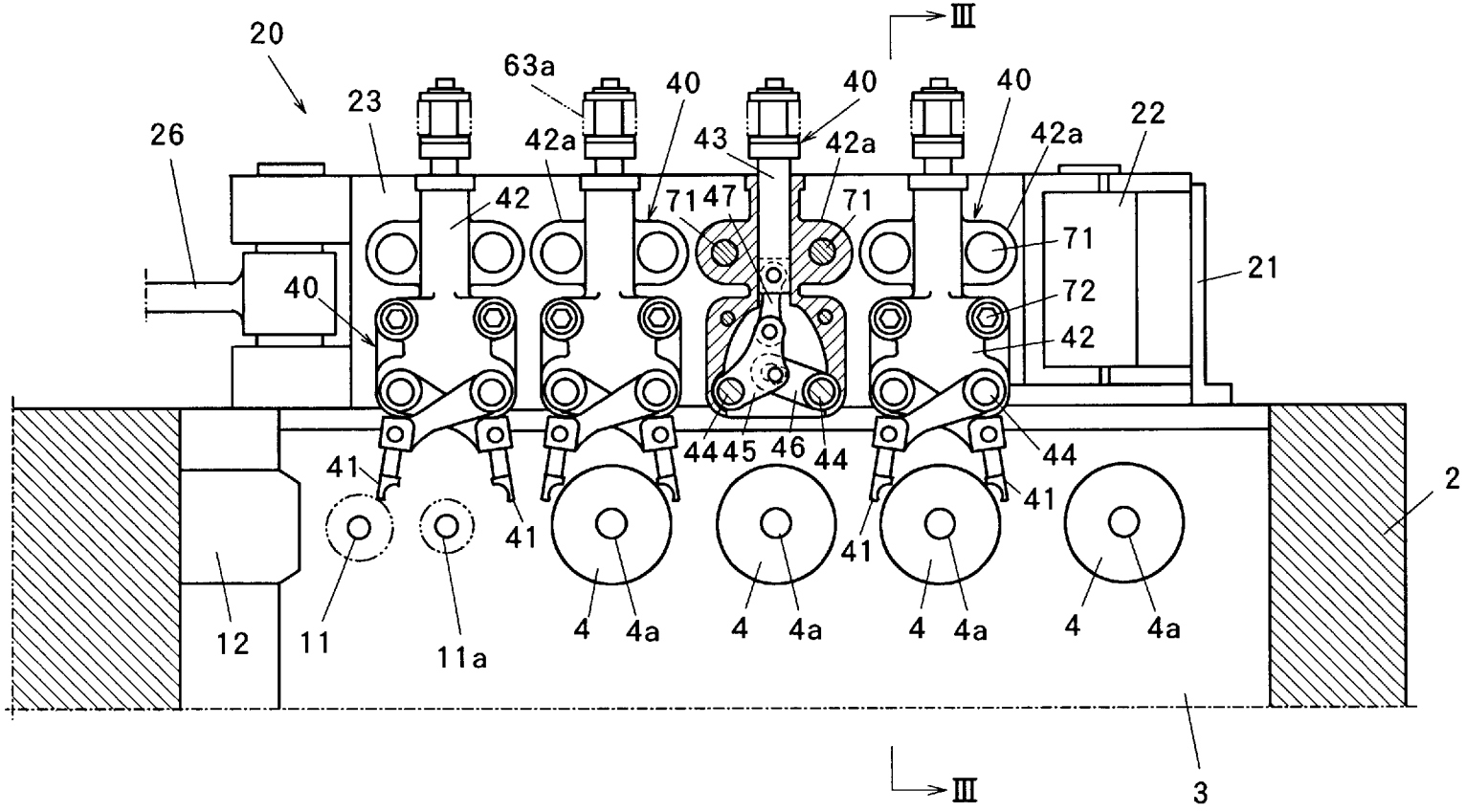
FIG. 2 is an enlarged cross sectional and partially broken view taken in the direction of the arrows I—I in FIG. 1.

As shown in FIGS. 1 and 2, a multi-stage forging apparatus 1 provided with a work transfer of the invention comprises a base frame 2, at a predetermined position of which is supported a die bank 3 provided with a plurality of dies 4 . . . 4 aligned horizontally to leave equal spacings therebetween. The dies 4 . . . 4 have die bores 4*a* . . . 4*a* of different shapes each other to stepwise refine a work. The base frame 2 further comprises a ram 5 opposite the die bank 3. On a front face of the ram 5 are disposed the same number of punches 6 . . . 6 as the dies 4 . . . 4, and each combination of corresponding die 4 and punch 6 defines a forging station, respectively. The ram 5 is, at its rear portion, connected to a crankshaft 9 via a connecting member 10. The crankshaft 9 is, at its one end, integrally fixed to a fly wheel 8 rotated by a driving motor 7 as a driver of the forging apparatus 1. Thus, the ram 5 is moved forward and backward, i.e., toward and away from the die bank 3 by a driving force applied by the driving motor 7.

As particularly shown in FIG. 2, the die bank 3 is further equipped with a quill 11 for feeding a rod-shape raw material to the forging apparatus 1. The raw material fed by the quill 11 is cut by a cutter 12 into a cylindrical work of a predetermined length, and then, the work is transported to a front of a pusher 11*a* installed in the die bank 3 next to the quill 11. The work is so pushed by the pusher 11*a* as to reach a grasping position of a first chuck 40 of the work transfer 20 which is mounted above the die bank 3 for successively transferring the work throughout the forging stations.

Figure 3:
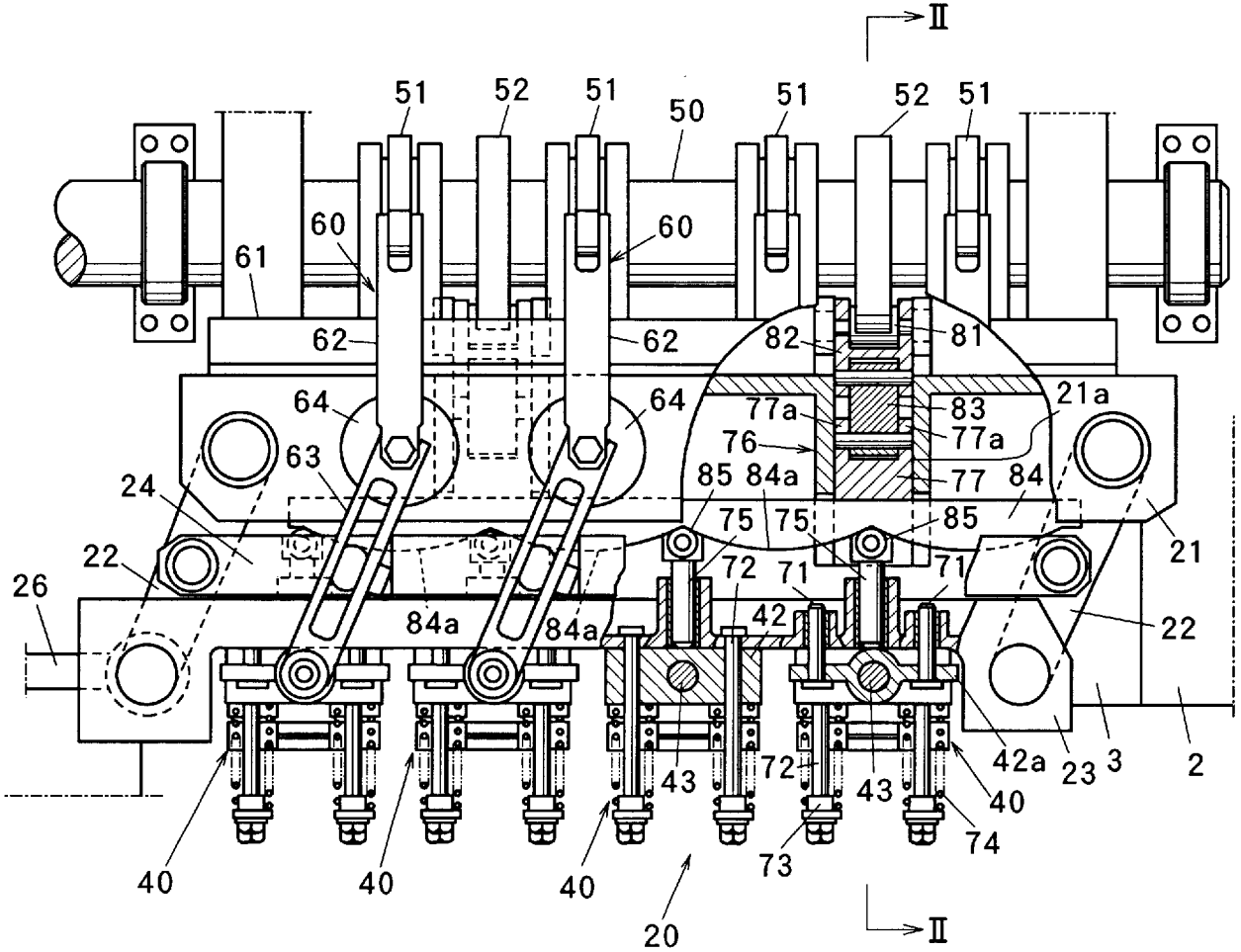
FIG. 3 is a partially broken enlarged plan view of the forging apparatus showing details of the work transfer.

A structure of the work transfer 20 which is the subject matter of the invention will be further described in detail, which is as follows:

The work transfer 20, as shown in FIGS. 1 to 3, includes a frame 21 secured to an upper surface of the base frame 2, a pair of arms 22, 22 each swingably supported to either side end of the fixed frame 21 at its one end portion, a movable frame 23 having a vertical wall and linked to other end portion of each swing arm 22 at either side end thereof, a middle frame 24 rotatably connected to a midportion of each arm 22 at either side end thereof, and a plurality of chucks 40 . . . 40, as hereinafter more fully described, aligned horizontally on the vertical wall of the movable frame 23 to leave same spacings therebetween similar to the dies 4 . . . 4.

The movable frame 23 and the chucks 40 . . . 40 are moved to reciprocate in a horizontal plane, along an arc between the adjacent dies 4, 4, synchronizing with the reciprocating motion, i.e., a forging motion of the ram 5, a mechanism of which is as follows:

As shown in FIG. 1, at the other end of the crankshaft 9 is fixed a drive gear 35 contacting a middle gear 36 integrally secured to a bevel gear 37 which is engaged with the second bevel gear 34 fixed to one end of a drive shaft 32 rotatably supported by support members 29, 31 at one side of the base frame 2, the drive shaft 32 being extending perpendicular to the crankshaft 9 in the horizontal plane, so that both the drive shaft 32 and the crankshaft 9 are rotated synchronously each other by the driving motor 7. On the drive shaft 32 is disposed a cam 33 at a predetermined position, and a lever 28, an upper portion of which is biased by a spring (not shown) always to follow a profile of the cam 33, is swingably supported by a bracket 27 at one side of the base frame 2 so that the lever 28 swings once according to a rotation of the cam 33 as the drive shaft 32 and the crankshaft 9 rotate once. The swing lever 28 is provided with a drive rod 26, either end of which is rotatably connected to an lower portion of the swing lever 28 and to a side end portion of the movable frame 23, respectively (see also FIGS. 2 and 3). Thus, as the drive shaft 32 and the crankshaft 9 rotate once, the ram 5 reciprocates, i.e., moves toward and away from the die bank 3 once, and synchronizing with this forging motion of the ram 5, the movable frame 23 and the chucks 40 . . . 40 reciprocates, i.e., moves between the adjacent dies 4, 4 once by a push-pull motion of the drive rod 26 as the swing lever 28 swings once.

As shown in FIG. 1, behind the dies 4 . . . 4, is equipped a knockout means 38 for pushing the works, which have been forged by the punches 6 . . . 6 in the die bores 4*a* . . . 4*a*, out of the die bores 4*a* . . . 4*a* synchronously with a withdrawing motion in the forging stroke of the ram 5. The knockout means 38, as particularly shown in FIG. 4, includes knockout pins 39 . . . 39, each installed in corresponding die 4, respectively, for kicking out the forged work X left in the die bore 4*a* so that each chuck 40 of the transfer 20 can grasp the corresponding work X. In this case, a knockout pin 39 installed in the die 4 of the third forging station has a protrusion 39*a* at its front end for forming a recess X4 (see FIG. 15) at a rear end portion of the work X when forging.

Figure 4:
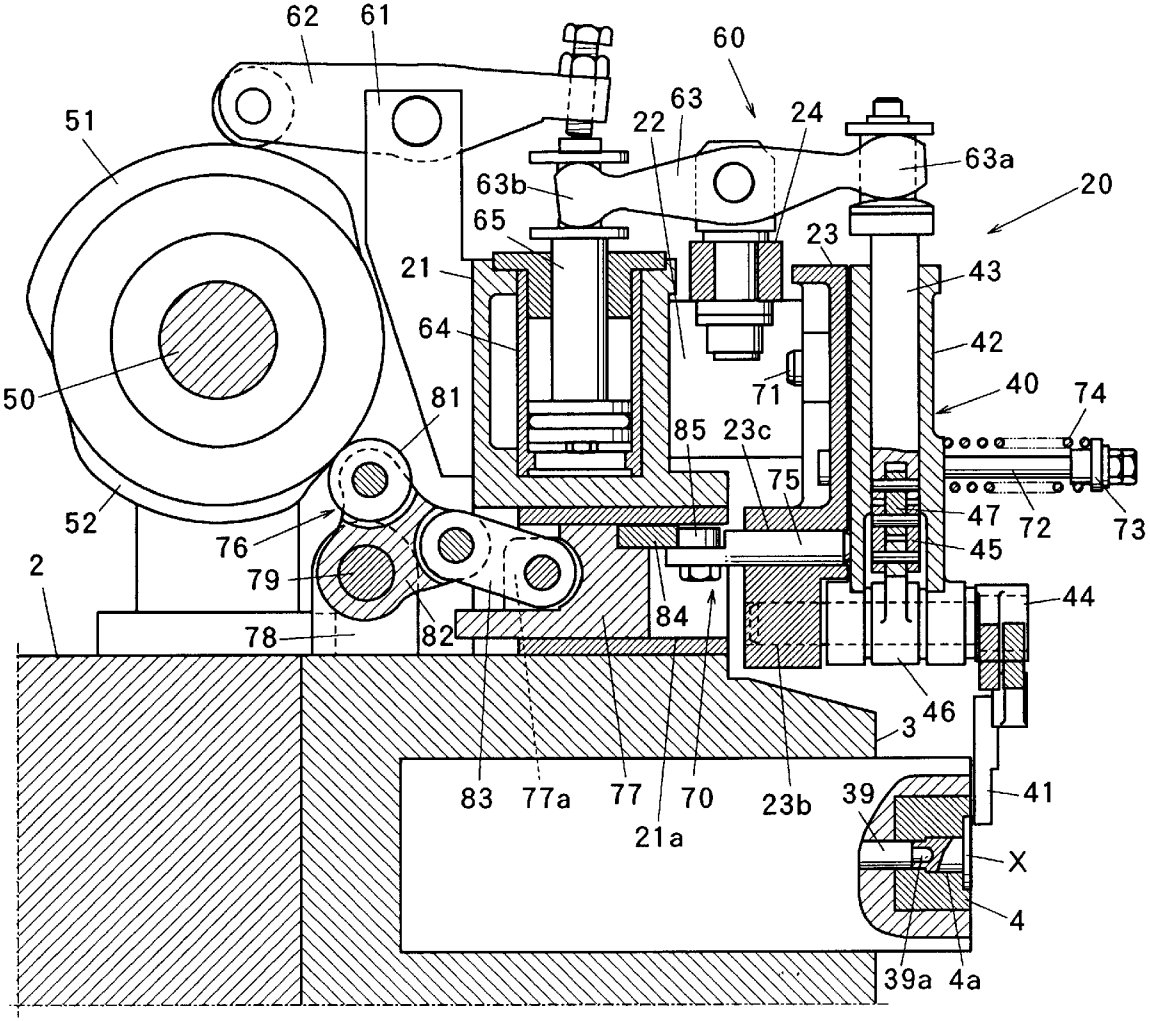
FIG. 4 is an enlarged cross sectional view taken in the direction of the arrows II—II in FIG. 3

According to the work transfer 20 of the embodiment, as shown in FIGS. 2 and 4, the chuck 40 has a pair of finger members 41, 41 capable of opening and closing each other, and the chuck 20 is so supported to the movable frame 23 as to be able to approach to and recede from a front face of the movable frame 23 with the result that the finger members 41, 41 approach to and recede from a front face of the die 4. And in order to open and close the finger members 41, 41 each other, and to move the chuck 20 so that it approaches to and recedes from a front face of the movable frame 23, the work transfer 20 of the embodiment, as shown in FIGS. 1, 3 and 4, comprises a camshaft 50 which synchronously rotates with the forging motion of the ram 5, a chuck open-close mechanism 60 to be operated according to the rotation of the camshaft 50, and a chuck approach-recede mechanism 70 also to be operated according to the rotation of the camshaft 50.

As shown in FIGS. 2 and 4, each chuck 40 includes a chuck holder 42 in front of the vertical wall of the movable frame 23, an axle 43 slidable in a vertical direction in the holder 42, a pair of pins 44, 44, each rotatably provided at either side of a lower portion of the holder 42, at protrudent ends of pins 44, 44 being connected the finger members 41, 41, respectively, a pair of levers 45, 46 fixed to the pins 44, 44 respectively and engaged each other, and a linking rod 47 linking a lower end of the axle 43 and an upper end of one of the levers 45, 46. Thus, as the chuck axle 43 ascends the levers 45, 46 are, via the linking rod 47, moved to rotate the finger-connected pins 44, 44 so as to open the finger members 41, 41, and on the other hand, as the axle 43 descends the levers 45, 46 are, via the linking rod 47, moved to rotate the finger-connected pins 44, 44 reversely so as to close the finger members 41, 41.

The camshaft 50, as shown in FIGS. 3 and 4, is rotatably placed behind the fixed frame 21 on the upper surface of the base frame 2, and on the camshaft 50, are secured a plurality of cams 51 . . . 51 of the chuck open-close mechanism 60 and other two cams 52, 52 of the chuck approach-recede mechanism 70. As particularly shown in FIG. 1, at one end of the camshaft 50 and the other end of the drive shaft 32, are fixed bevel gears 53 and 54, respectively, both being engaged with a power transmission 55 disposed between them so that the camshaft 50 synchronously rotates with the drive shaft 32 and the crankshaft 9, thus, with the forging motion of the ram 5 and punches 6 . . . 6.

As shown in FIGS. 3 and 4, the chuck open-close mechanism 60 includes cam arms 62 . . . 62, each swingably supported by a bracket 61 disposed to a rear face of the fixed frame 21, rocker arms 63 . . . 63, each rockably disposed on a middle frame 24, and cylinders 64 . . . 64 installed in the fixed frame 21, piston rods 65 . . . 65 of the cylinders 64 . . . 64 being always forced upward. Front end portions of the cam arms 62 . . . 62 are adjustably placed on tops of the piston rods 65 . . . 65 and rear end portions of the cam arms 62 . . . 62 are always in contact to profiles of the chuck open-close cams 51 . . . 51. Both front and rear end portions of the rocker arms 63 . . . 63 are two-forked, and the front end portions 63*a* . . . 63*a* are engaged with upper portions of the chuck axles 43 . . . 43 of the chucks 40 . . . 40 and the rear end portions 63*b* . . . 63*b* are engaged with upper portions of the piston rods 65 . . . 65 of the cylinders 64 . . . 64.

Therefore, as the camshaft 50 rotates, especially when the rear end portion of the cam arm 62 is pushed up according to the profile of the cam 51, the front end portion of the cam arm 62 pushes down the piston rod 65 and the rear end portion 63*b* of the rocker arm 63 against the upward force applied by the cylinder 64, and the front end portion 63*a* of the rocker arm 63 pulls up the chuck axle 43, whereby the finger members 41, 41 are operated to open for releasing the work X. On the other hand, especially when the rear end portion of the cam arm 62 is pushed down according to the profile of the cam 51 due to the upward force applied by the cylinder 64, the front end portion of the cam arm 62 and the rear end portion 63*b* of the rocker arm 63 are pushed up by the piston rod 65, and the front end portion 63*a* of the rocker arm 63 pushes down the chuck axle 43, whereby the finger members 41, 41 are operated to close for grasping the work X kicked out of the die bore 4*a* by the knockout pin 39.

Figure 5:
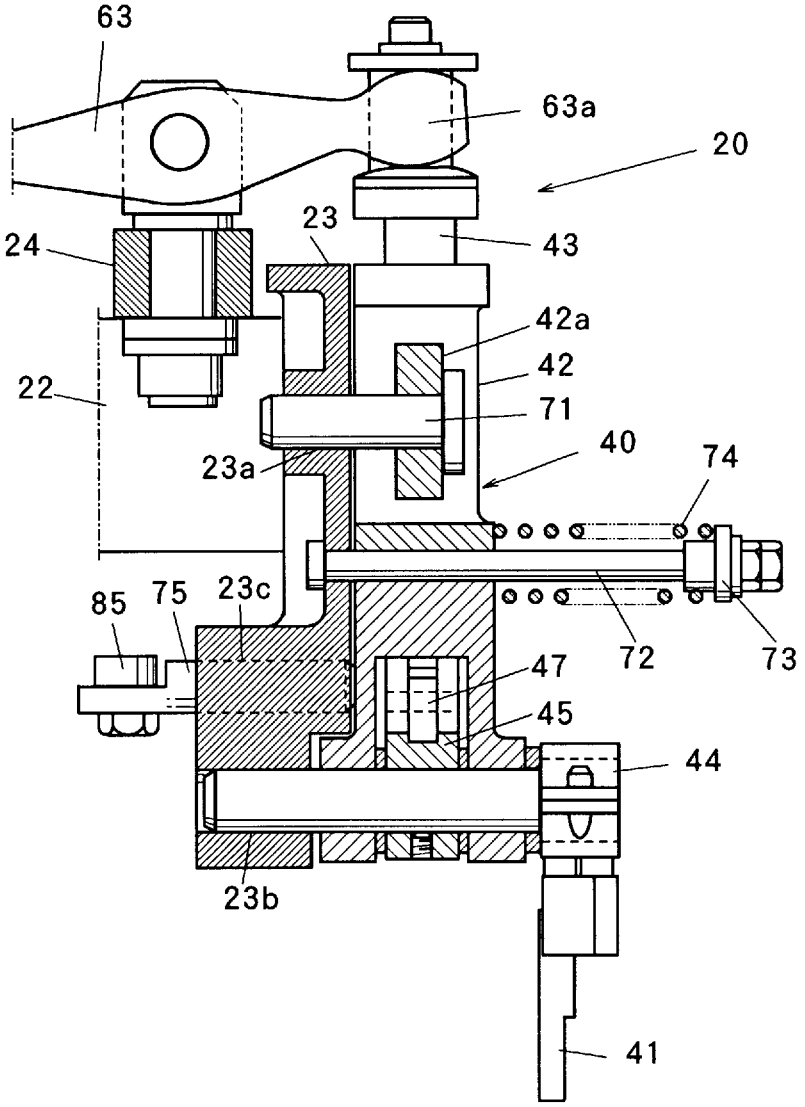
FIG. 5 is an enlarged cross sectional view taken in the direction of the arrows III—III in FIG. 2

On the other hand, the chuck approach-recede mechanism 70 is constituted as follows:

As shown in FIGS. 2, 3 and 5, the chuck holder 42 has flanges 42*a*, 42*a* at its both sides of an upper portion, and to each flange 42*a* is secured a guide rod 71 which extends through a guide hole 23*a* formed in the vertical wall of the movable frame 23, respectively. In the same manner, each finger-connected pin 44 extends through a guide hole 23*b* formed at a lower portion of the vertical wall of the movable frame 23, respectively. The guide rods 71, 71 and finger-connected pins 44, 44 pass through the respective holes 23*a*, 23*a*, 23*b*, 23*b* slidably, and thus, the chuck 40 is supported to the movable frame 23 slidably in a direction perpendicular to the front face of the movable frame 23, i.e., parallel to the forging direction.

The movable frame 23 is further provided with another longer pins 72, 72 fixed therto extending in a direction of the ram 5 through either side of a midportion of the chuck holder 42, respectively, and between receive members 73, 73 disposed at front ends of the protrudent pins 72, 72 and front face of the chuck holder 42, are interposed springs 74, 74 for biasing the chuck holder 42 toward the front face of the movable frame 23.

As shown in FIG. 4, at relatively lower portion of the movable frame 23 are formed another guide holes 23*c* . . . 23*c* whose longitudinal axes extend in the kicking direction of the knockout means 38 and the forging direction of the ram 5, and through the guide holes 23*c* . . . 23*c* are slidably passing push rods 75 . . . 75 for pushing the chuck 40 . . . 40 away from the front face of the movable frame 23 against the biasing force applied by the springs 74, 74 . . . 74, 74.

The push rods 75 . . . 75 are driven by an assosiat transmission mechanism 76 which is operated according to the rotation of the cams 52, 52 disposed on the camshaft 50. The transmission mechanism 76, as shown in FIGS. 3 and 4, includes a slide member 77 slidably placed in a groove 21*a* so formed at a lower portion of the fixed frame 21 to extend in the forging direction, a support member 78 secured in a rear of the fixed frame 21, a swing member 82 rotatably supported to the support member 78 around a shaft 79, a cam follower 81 attached to a rear end of the swing member 82, where the swing member 82 is so biased by unshown spring that the cam follower 81 contacts to a profile of the cam 52 steadily, and a middle link 83, either end of which is rotatably connected to a front end of the swing member 82 and a connecting portion 77*a* formed at a rear end of the slide member 77.

A profile of the cams 52 for the chuck approach-recede mechanism disposed on the camshaft 50 is so formed that from a time that the work X is grasped by the finger members 41, 41 to a time that the work X is transferred to the next die of the downstream forging station, the push rod 75 is driven forward relative to the movable frame 23 against the biasing force of the springs 74, 74 via the assosiattransmission mechanism 76, and at a time that the work X is transferred to the next die of the downstream forging station, the push rod 75 is pushed backward relative to the movable frame 23 due to the biasing force of the springs 74, 74.

In this embodiment, because the movable frame 23 is, as the arms 22, 22 swing, reciprocated through the arc between the adjacent dies 4, 4, at a front end of the slide member 77, as shown in FIGS. 3 and 4, is attached a cam plate 84 having cam portions 84*a* . . . 84*a*, each curved forward between the adjacent dies 4, 4, and at a rear portion of the push rod 75 is provided a roller 85 for contacting the curved cam portion 84*a*.

Figure 15:
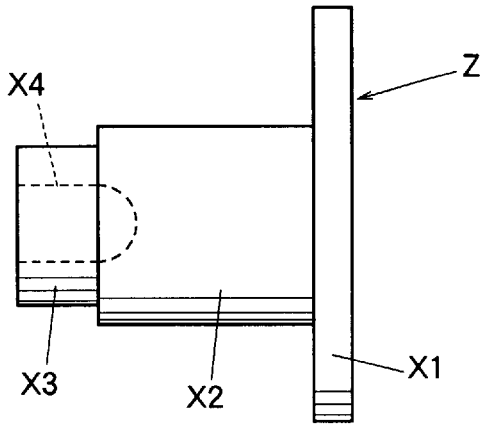
FIGS. 15 is a side view of a product fabricated by the multi-stage forging apparatus according to the embodiments of the invention.

The operation of the work transfer 20 described above will now be explained referring to FIGS. 6 and 7 which show the third forging station where the work X is transferred to the last station. The work X is, at the third forging station, forged almost close to a finished product, a bottom plate Z for a speaker, as shown in FIG. 15, having a thin flange X1 of bigger diameter at a front portion, a relatively longer tubular midportion X2 of smaller diameter, a relatively shorter tubular rear portion X3 of still further smaller diameter, and a recess X4 in the rear portion X3.

Figure 6:
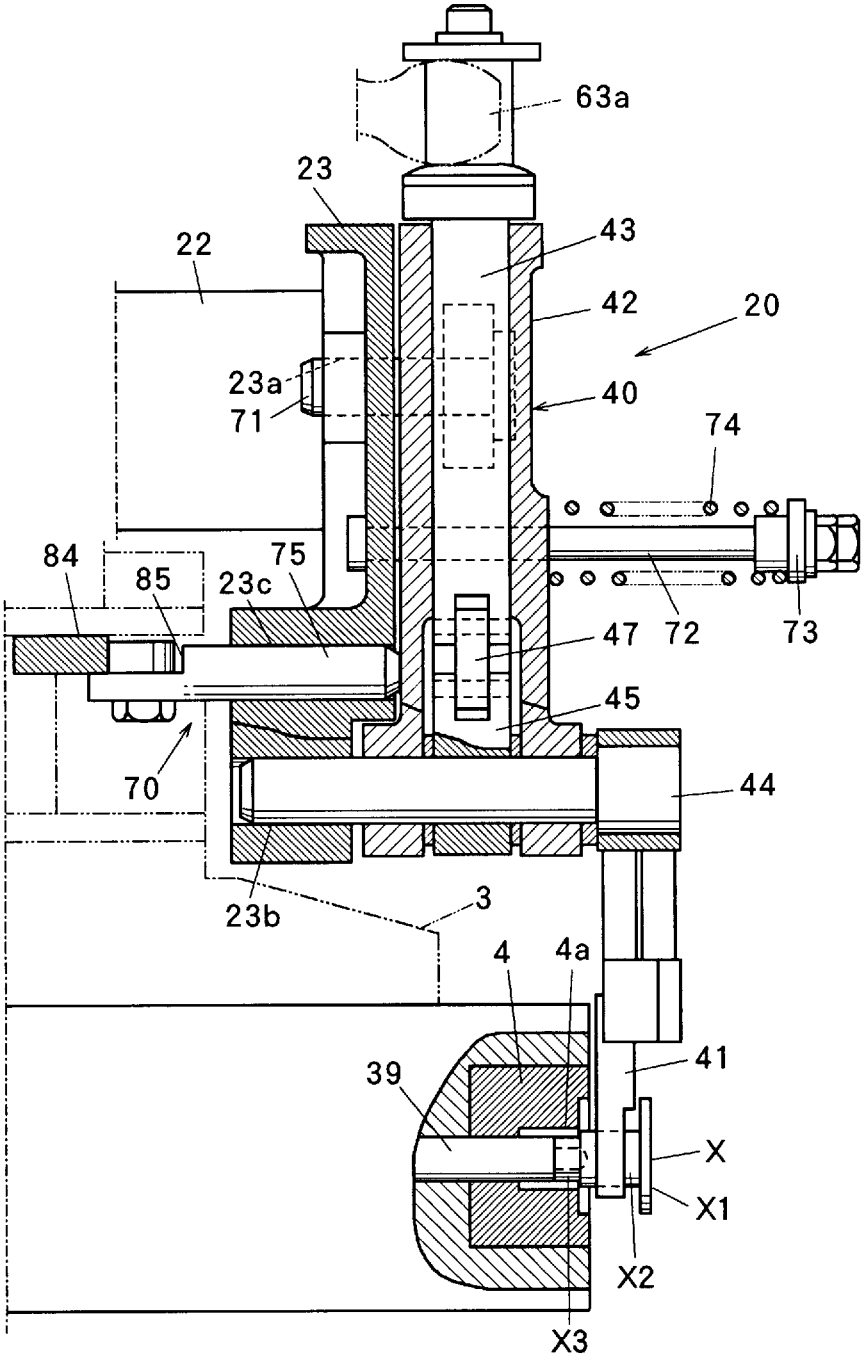
FIGS. 6 and 7 are enlarged cross sectional views, similar to FIG. 5, showing a motion of a transfer chuck of the work transfer during a withdrawing period of the punch.

Just as is shown in FIG. 6, when the forged work X is, by the knockout pin 39, pushed out of the die 4 to a predetermined position where the work X is not yet tilted but still in a correct horizontal posture relative to the die 4, the rear portion of the cam arm 62, which has been pushed up by the profile of the cam 51 for the chuck open-close mechanism 60, is pushed down due to the push-up of the front portion of the cam arm 62 by the upward force applied by the cylinder 64 as the camshaft 50 and the cam 51 rotates synchronously with the forging motion of the ram 5, and the piston rod 65 of the cylinder 64 expands upward. Then, the rocker arm 63 of the chuck open-close mechanism 60 so swings that the chuck axle 43 descends, whereby the pair of finger members 41, 41 of the chuck 40 is operated to close each other, and the work X is grasped by the finger members 41, 41 at its tubular midportion X2.

Figure 7:
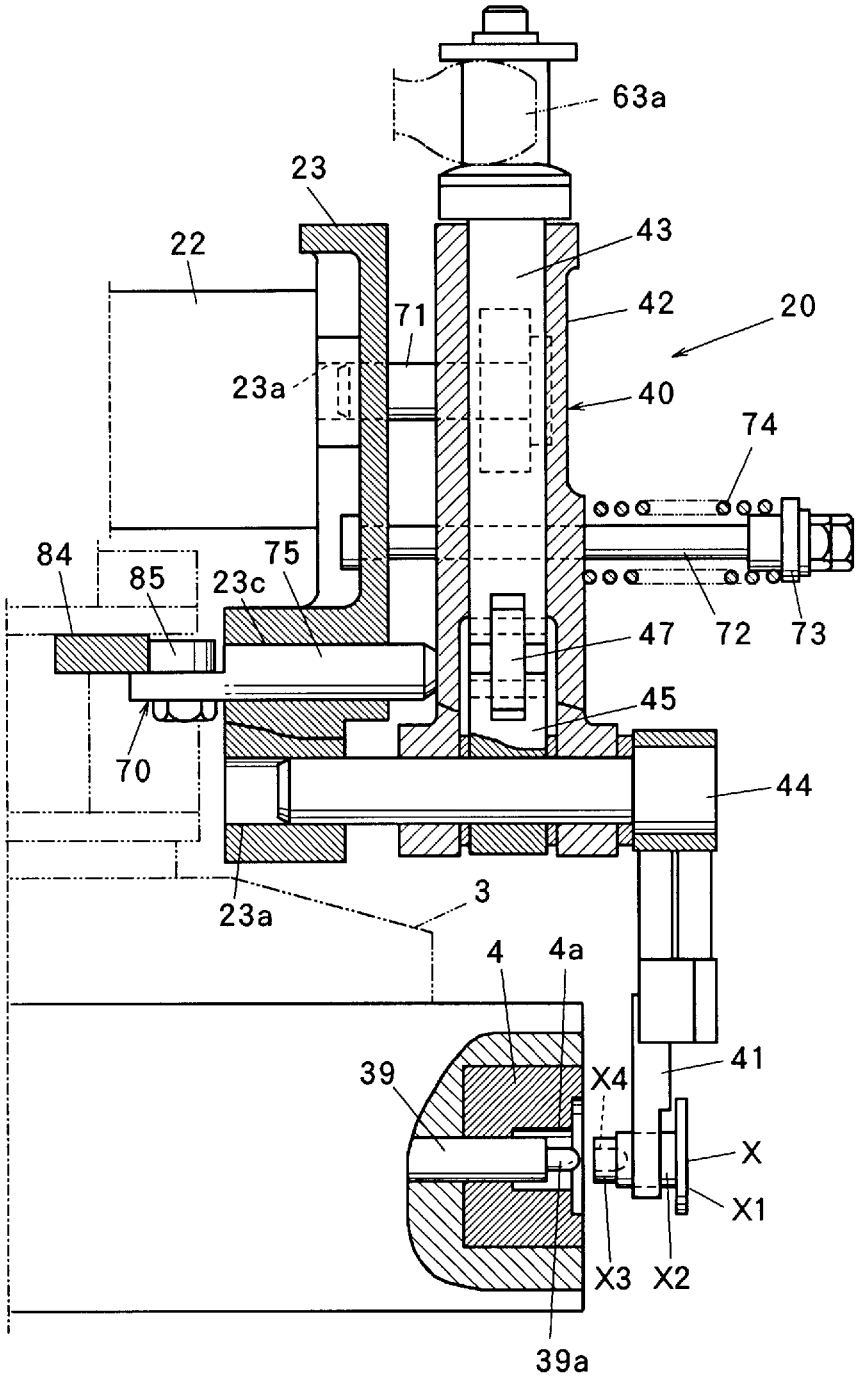

When the work X is grasped by the finger members 41, 41 in this manner, the push rod 75 is, as shown in FIG. 7, by the cam 52 for the chuck approach-recede mechanism 70 disposed on the camshaft 50, pushed forward from the front face of the movable frame 23 against the biasing force of the springs 74, 74 via the cam follower 81, swing member 82, middle link 83, slide member 77 and cam plate 84 of the chuck approach-recede mechanism 70 so that the chuck 40 is driven to recede from the front face of the movable frame 23. Consequently, the finger members 41, 41 also recede from the front face of the die 4, and the rear portion of the work X, which portion has been left yet in the die bore, is fully extracted out of the bore 4*a*. Especially, in case that the knockout pin 39 has the protrusion 39*a* at its front end and the work X has the recess X4 at its tubular rear portion X3, as in this embodiment, the work X can be drawn out smoothly without forcing or prying even though the protrusion 39*a* and the recess X4 have been engaged.

Then, the chuck 40 transfers the work X to the next die 4 according to the movement of the movable frame 23 while the chuck 40 is in a receding position from the front face of the frame 23 due to the cooperation of the assosiat transmission mechanism 76 and the push rod 75. When the transfer of the work X has completed, the push rod 75 is withdrawn backward by the biasing force of the springs 74, 74 as the slide member 77 of the assosiat transmission mechanism 76 slides backward due to the rotation of the cam 52, and the chuck 40 is moved to approach to the front face of the movable frame 23. Consequently, the finger members 41, 41 also approach to the front face of the die 4 resulting in that the transferred work X is, at its rear portion, partly inserted into the bore 4*a* of the next die, and then, the work X is fully driven into the bore 4*a* by the forging motion of the punch 6. At this time, the rear portion of the cam arm 62 is pushed up according to the rotation of the cam 51 for the chuck open-close mechanism 60, and the piston rod 65 of the cylinder 64 contracts downward. Then, the cam arm 62 and the rocker arm 63 so swing that the chuck axle 43 ascends, where the pair of finger members 41, 41 of the chuck 40 is operated to open each other and the work X is released from the finger members 41, 41.

And then, the chuck 40 is moved to return to the front of the previous die 4 according to the returning movement of the movable frame 23 while the pair of finger members 41, 41 are kept open each other.

In this embodiment, because the knockout pin 39 in the die 4 of the third forging station has the protrusion 39*a* at its front end for forming the recess X4 at the rear end of the work X, the direction of approach-recede motion of the finger members 41, 41 is preferably paralell to a straight center axis of the die 4 so as to release the engagement of the protrusion 39*a* and the recess X4 smoothly. But, in case that such a recess like above X4 is not to be formed in the work, thus, any protrusions like above 39*a* are not provided at front end of the knockout pin, the finger members 41, 41 may approach to and recede from the front face of the die through an arc, for instance. In this case, the guide rods 71, 71 and finger-connected pins 44, 44 for sliding the chuck holder 42 straightly along the center axis of the die 4 in the above embodiment are replaced by a shaft extending in a direction parallel to a direction in which the movable frame 23 elongates, and the chuck holder 42 is rotatably supported to the shaft so that the chuck holder 42 may swing around the shaft in a vertical plane perpendicular to the direction in which the movable frame 23 and the shaft elongates.

The push rod 75 may be provided for only the chuck 40, the finger members 41, 41 of which must be moved to approach to and recede from the die 4 because of the shape of the work to grasp and transfer. Alternatively, the push rod 75 may be provided for each of the all chucks 40 . . . 40, and it is also possible to provide the chuck approach-recede mechanism 70 for each chuck 40 independently, as occasion demands.

Alternatively, FIGS. 8 to 11 show another embodiment of the invention, in which the same reference characters as those used in the above first embodiment designate like or corresponding parts.

Figure 8:
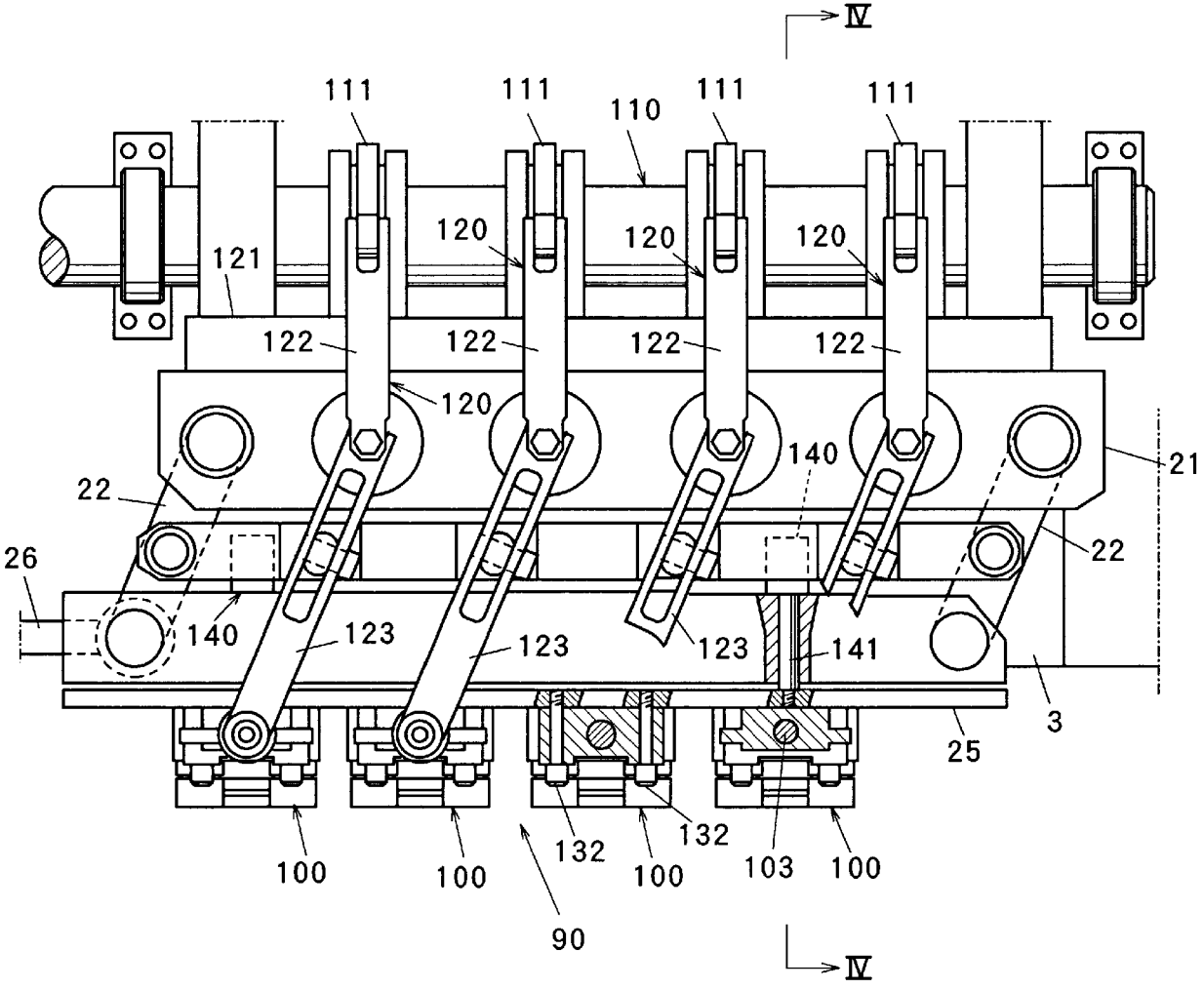
FIG. 8 is, similar to FIG. 3, a partially broken enlarged plan view of a multi-stage forging apparatus showing details of a work transfer according to another embodiment of the invention.
Figure 9:
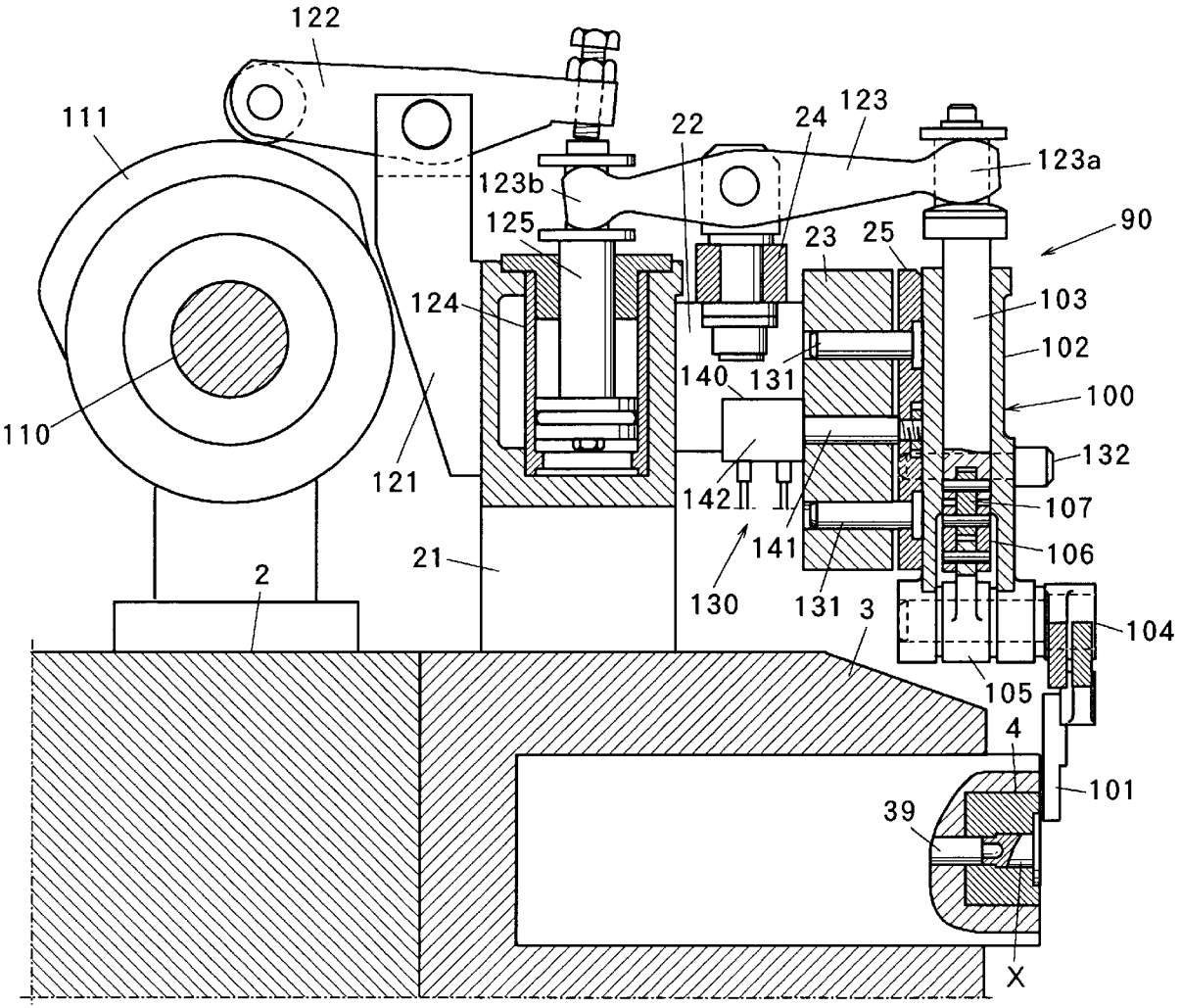
FIG. 9 is, similar to FIG. 4, an enlarged cross sectional view taken in the direction of the arrows IV—IV in FIG. 8.

According to the work transfer 90 of this second embodiment, as shown in FIGS. 8 and 9, similar to the first embodiment, the chuck 100 has a pair of finger members 101, 101 capable of opening and closing each other, and the chuck 100 is so supported to the movable frame 23 as to be able to approach to and recede from a front face of the movable frame 23 with the result that the finger members 101, 101 approach to and recede from a front face of the die 4. And in order to open and close the finger members 101, 101 each other, and to move the chuck 100 so that it approaches to and recedes from a front face of the movable frame 23, the work transfer 90 of the embodiment comprises a camshaft 110 which synchronously rotates with the forging motion of the ram 5, a chuck open-close mechanism 120 operated according to the rotation of the camshaft 110, a chuck approach-recede mechanism 130, including a cylinder 140 fixed to the movable frame 23, for moving the chuck 100 so that the chuck 100 approaches to and recedes from the front face of the movable frame 23, and a controlling means for controlling the cylinder 140.

As shown in FIGS. 8 and 9, similar to the first embodiment, each chuck 100 includes a chuck holder 102 in front of the vertical wall of the movable frame 23, an axle 103 slidable in a vertical direction in the holder 102, a pair of pins 104, 104 rotatably passing through a lower portion of the holder 102, at protrudent ends of pins 104, 104 being connected the finger members 101, 101, respectively, a pair of levers 105, 106 fixed to the pins 104, 104 respectively and engaged each other, a linking rod 107 linking a lower end of the axle 103 and an upper end of one of the levers 105, 106. Thus, as the chuck axle 103 ascends, the levers 105, 106 are, via the linking rod 107, moved to rotate the finger-connected pins 104, 104 so as to open the finger members 101, 101, and on the other hand, as the axle 103 descends, the levers 105, 106 are, via the linking rod 107, moved reversely to rotate the finger-connected pins 104, 104 so as to close the finger members 101, 101.

The camshaft 110 is, as shown in FIGS. 8 and 9, similar to the first embodiment, rotatably placed behind the fixed frame 21 on the upper surface of the base frame 2, and on the camshaft 110, are secured a plurality of cams 111 . . . 111 of the chuck open-close mechanism 120.

As shown in FIGS. 8 and 9, similar to the first embodiment, the chuck open-close mechanism 120 includes cam arms 122 . . . 122, each swingably supported by a bracket 121 disposed to a rear face of the fixed frame 21, rocker arms 123 . . . 123, each rockably disposed on a middle frame 24, and cylinders 124 . . . 124 installed in the fixed frame 21, piston rods 125 . . . 125 of the cylinders 124 . . . 124 being always forced upward. Front end portions of the cam arms 122 . . . 122 are adjustably placed on tops of the piston rods 125 . . . 125 and rear end portions of the cam arms 122 . . . 122 are always in contact with profiles of the chuck open-close cams 111 . . . 111. Both front and rear end portions of the rocker arms 123 . . . 123 are two-forked, and the front end portions 123*a* . . . 123*a* are engaged with upper portions of the chuck axles 103 . . . 103 of the chucks 100 . . . 100 and the rear end portions 123*b* . . . 123*b* are engaged with upper portions of the piston rods 125 . . . 125 of the cylinders 124 . . . 124.

Therefore, as the camshaft 110 rotates, when the rear end portion of the cam arm 122 is pushed up according to a profile of the cam 111, the front end portion of the cam arm 122 pushes down the piston rod 125 and the rear end portion 123*b* of the rocker arm 123, and the front end portion 123*a* of the rocker arm 123 pulls up the chuck axle 103, whereby the finger members 101, 101 are operated to open for releasing the work. On the other hand, when the rear end portion of the cam arm 122 is pushed down according to the profile of the cam 111, the front end portion of the cam arm 122 and the rear end portion 123*b* of the rocker arm 123 are pushed up by the piston rod 125, and the front end portion 123*a* of the rocker arm 123 pushes down the chuck axle 103, whereby the finger members 101, 101 are operated to close for grasping the work kicked out of the die bore.

On the other hand, the chuck approach-recede mechanism 130 is constituted as follows:

As shown in FIGS. 8 and 9, in front of the movable frame 23 is vertically placed a supporting plate 25 having the same lateral length as the movable frame 23, and to the supporting plate 25 are secured a plurality of guide rods 131 . . . 131 which extend through guide holes 23*a* . . . 23*a* (see FIG. 10 or 11) formed in the vertical wall of the movable frame 23, respectively. The guide rods 131 . . . 131 pass through the respective holes 23*a* . . . 23*a* slidably, and thus, the supporting plate 25 is supported to the movable frame 23 slidably in a direction perpendicular to the movable frame 23. And to a front face of the supporting plate 25 are secured the chuck holders 102 . . . 102 of chucks 100 . . . 100 by bolts 132 . . . 132.

Behind the movable frame 23 is disposed a cylinder 140 having a body 142 fixed to a rear face of the movable frame 23 and a piston rod 141 which extends through a hole 23*b* (see FIG. 10 or 11) formed in a midportion of the vertical wall of the movable frame 23. The piston rod 141 reaches to the supporting plate 25 and is connected to the plate 25. Thus, the supporting plate 25 and the chucks 100 . . . 100 are moved to approach to and recede from the front face of the movable frame 23 by the expand-contract motion of the piston rod 141 of the cylinder 140.

Further, the chuck approach-recede mechanism 130 comprises, though it is not shown, a control unit having a solenoid valve, etc. as the controlling means for controlling the cylinder 140 in the following manner:

From a time that the work is grasped by the finger members 101, 101 to a time that the work is transferred to the next die of the downstream forging station, the piston rod 141 of the cylinder 140 expands forward so that the chucks 100 . . . 100 recede from the front face of the movable frame 23 and the finger members 101, 101 recede from the front face of the die 4, and at a time that the work is transferred to the next die of the downstream forging station, the piston rod 141 of the cylinder 140 contracts backward so that the chucks 100 . . . 100 approach to the front face of the movable frame 23 and the finger members 101, 101 approach to the front face of the die 4.

Because the cylinder 140 is also moved to reciprocate together with the movable frame 23 and the above-mentioned solenoid valve is mounted on the base frame 2, the solenoid valve and the cylinder 140 are connected by means of a flexible hose (not shown), for example.

The operation of the work transfer 90 described above will now be explained referring to FIGS. 10 and 11 which show, similar to the first embodiment, the third forging station where the work X is transferred to the fourth station. The work X is, at the third forging station, forged almost close to a finished product, a bottom plate Z for a speaker, as shown in FIG. 15, having a thin flange X1 of bigger diameter at a front portion, a relatively longer tubular midportion X2 of smaller diameter, a relatively shorter tubular rear portion X3 of still further smaller diameter, and a recess X4 in the rear portion X3.

Figure 10:
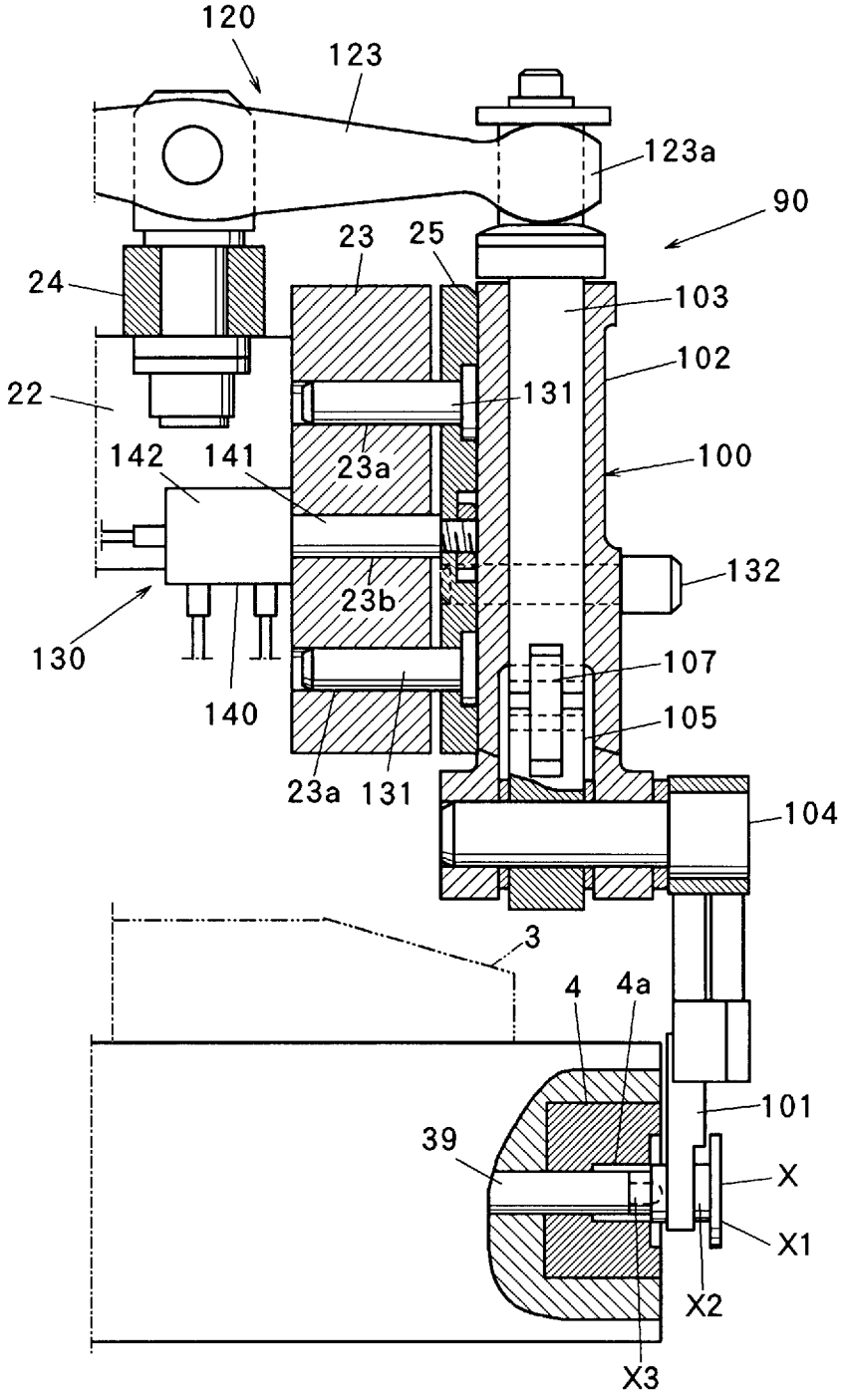
FIGS. 10 and 11 are enlarged cross sectional views, similar to FIGS. 6 and 7, respectively, showing a motion of a transfer chuck of the work transfer according to another embodiment of the invention during a withdrawing period of the punch.

Just as is shown in FIG. 10, when the forged work X is, by the knockout pin 39, pushed out of the die 4 to a predetermined position where the work X is not yet tilted but still in a correct horizontal posture relative to the die bore 4*a*, a push-up of the rear portion of the cam arm 122 by the chuck open-close cam 111 disposed on the camshaft 110 rotating synchronously with the forging motion of the ram 5 is cleared, and the piston rod 125 of the cylinder 124 expands upward. Then, the cam arm 122 and the rocker arm 123 of the chuck open-close mechanism 120 so swing that the chuck axle 103 descends, whereby the pair of finger members 101, 101 of the chuck 100 is operated to close each other and the work X is grasped by the finger members 101, 101 at its tubular midportion X2.

Figure 11:
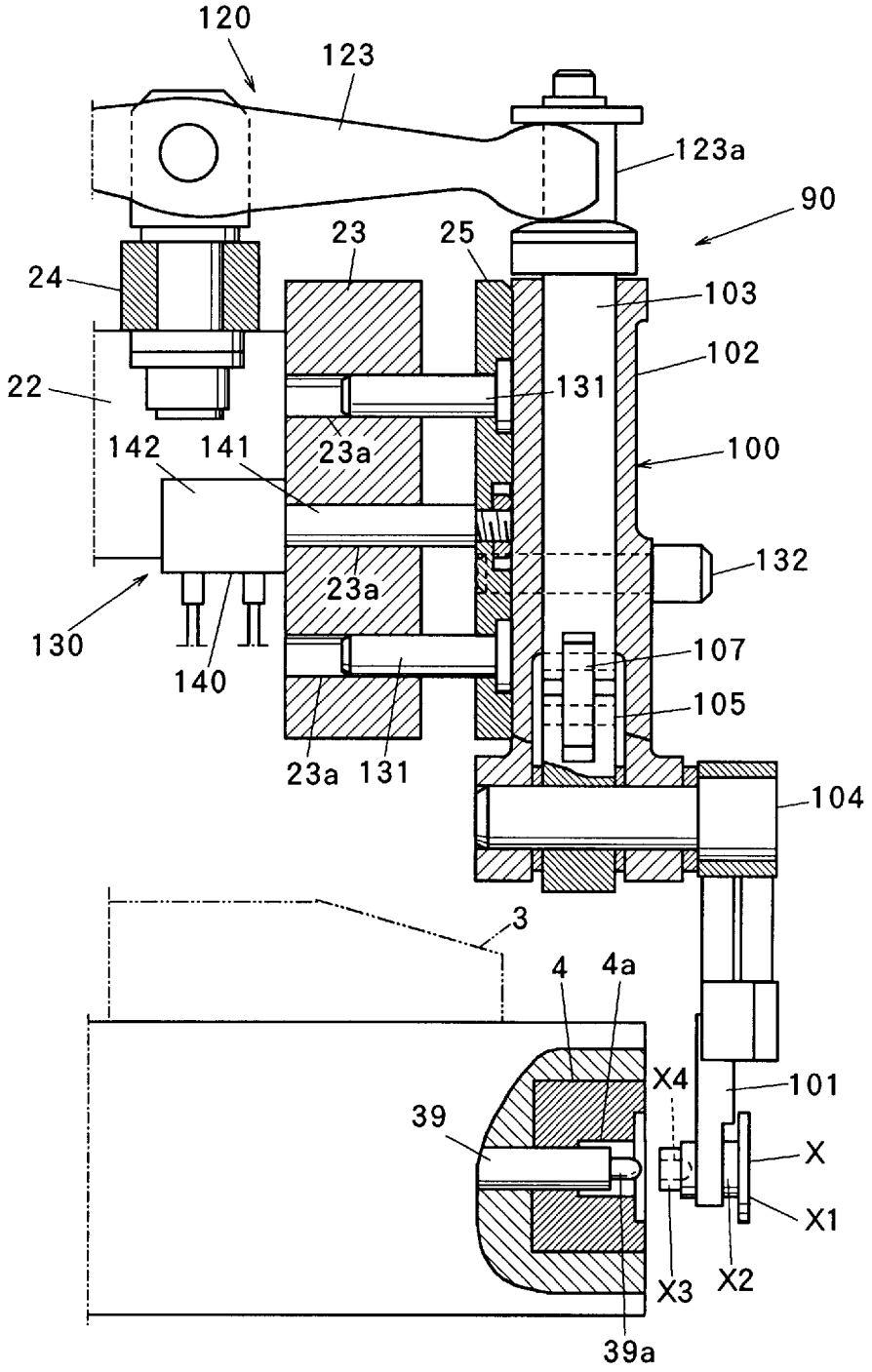

When the work X is grasped by the finger members 101, 101 in this manner, the cylinder 140 is so controlled by the control unit that the piston rod 141 thereof expands forward, as shown in FIG. 11, and the chuck 100 is moved to recede from the front face of the movable frame 23. Consequently, the finger members 101, 101 also recede from the front face of the die 4, and the rear portion of the work X, which portion has been still left in the die bore 4*a*, is fully extracted out of the bore 4*a*. Especially, in case that the knockout pin 39 has the protrusion 39*a* at its front end, as in this embodiment, the work X can be drawn out smoothly without forcing or prying even though the protrusion 39*a* and the recess X4 in the tubular rear portion X3 of the work X have been engaged.

Then, the chuck 100 transfers the work X to the next die 4 according to the movement of the movable frame 23, while the chuck 100 is in a receding position from the front face of the frame 23 under the control of the cylinder 140. When the transfer of the work X has completed, the cylinder 140 is so controlled by the control unit that the piston rod 141 thereof contracts backward, and the chuck 100 is moved to approach to the front face of the movable frame 23. Consequently, the finger members 101, 101 also approach to the front face of the die 4 and the transferred work X is partly inserted into the bore of next die at its rear portion, and then, the work X is fully driven into the bore by the forging motion of the punch 6. At this time, the rear portion of the cam arm 122 is pushed up according to the rotation of the chuck open-close cam 111, and the piston rod 125 of the cylinder 124 contracts downward. Then, the cam arm 122 and the rocker arm 123 so swing that the chuck axle 103 ascends, whereby the pair of finger members 101, 101 of the chuck 100 is operated to open each other and the work X is released from the finger members 101, 101.

And then, the chuck 100 is moved to return to the front of the previous die 4 according to the returning movement of the movable frame 23 while the pair of finger members 101, 101 are kept open each other.

Similar to the first embodiment, in this second embodiment, because the knockout pin 39 in the downstream die 4 has the protrusion 39*a* at its front end for forming the recess X4 at the rear end of the work X, the direction of approach-recede motion of the finger members 101, 101 is preferably a straight line along the center axis of the die 4 so as to release the engagement of the protrusion 39*a* and the recess X4 smoothly. But, in case that such a recess like above X4 is not to be formed in the work, thus, any protrusions like above 39*a* are not provided at front end of the knockout pin, the finger members 101, 101 may approach to and recede from the front face of the die through an arc, for instance. In this case, the guide rods 131 . . . 131 for sliding the supporting plate 25 and the chuck holder 102 straightly along the center axis of the die 4 in the above embodiment are replaced by a shaft extending in a direction parallel to the movable frame 23, to the shaft being rotatably supported the supporting plate 25 so as to be able to swing in a vertical plane perpendicular to the movable frame 23 and die bank 3 around the shaft.

The chuck approach-recede mechanism 130 may be so constructed as mentioned above that it moves all chucks 100 . . . 100 together via the supporting plate 25, or alternatively, the chuck approach-recede mechanism 130 may be independently provided for only specific chuck 100, the finger members 101, 101 of which must be moved to approach to and recede from the die 4 because of the shape of the work to grasp and transfer.

Figure 12:
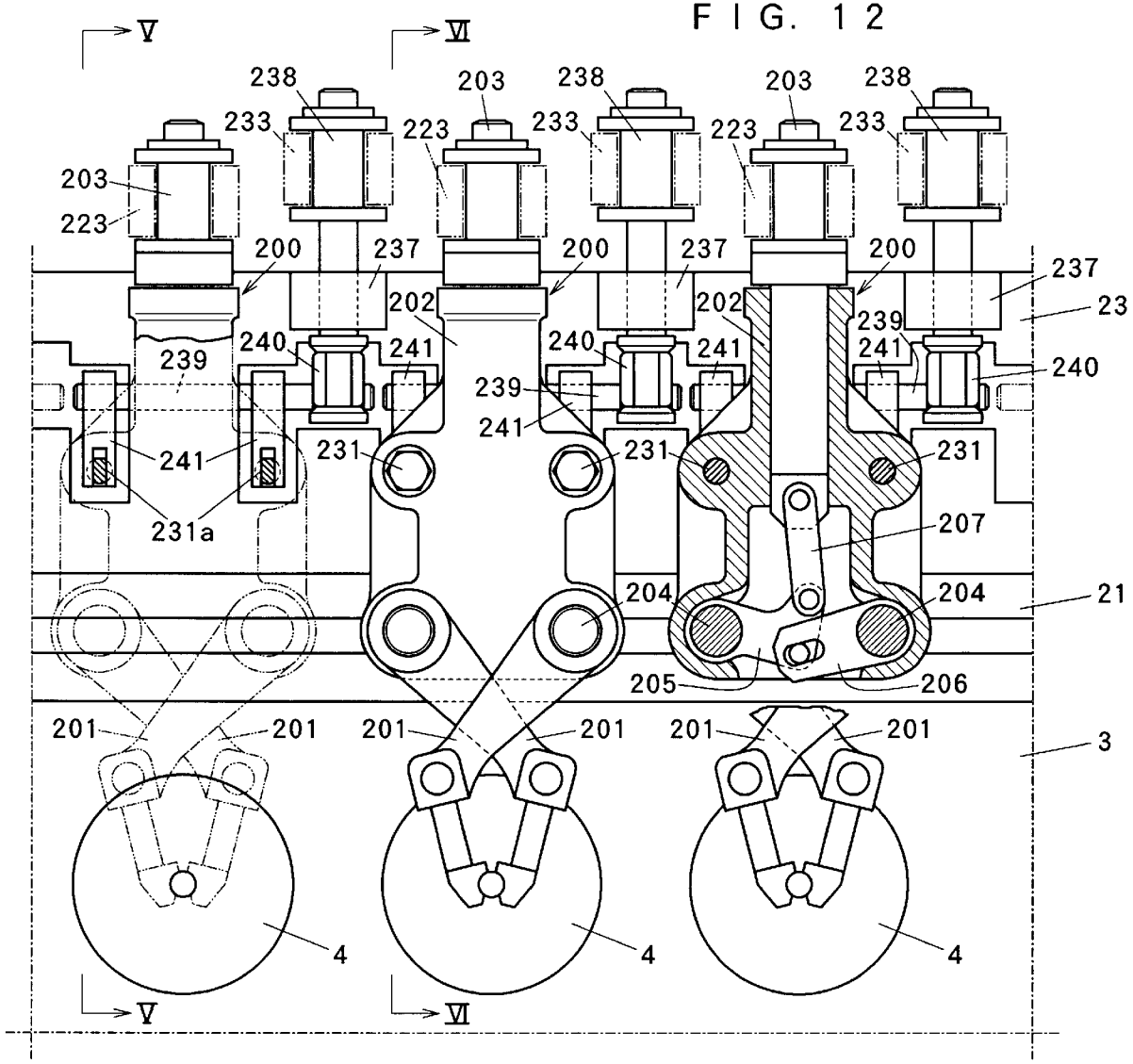
FIG. 12 is a partially broken enlarged view of a multi-stage forging apparatus showing details of a work transfer according to still another embodiment of the invention.
Figure 13:
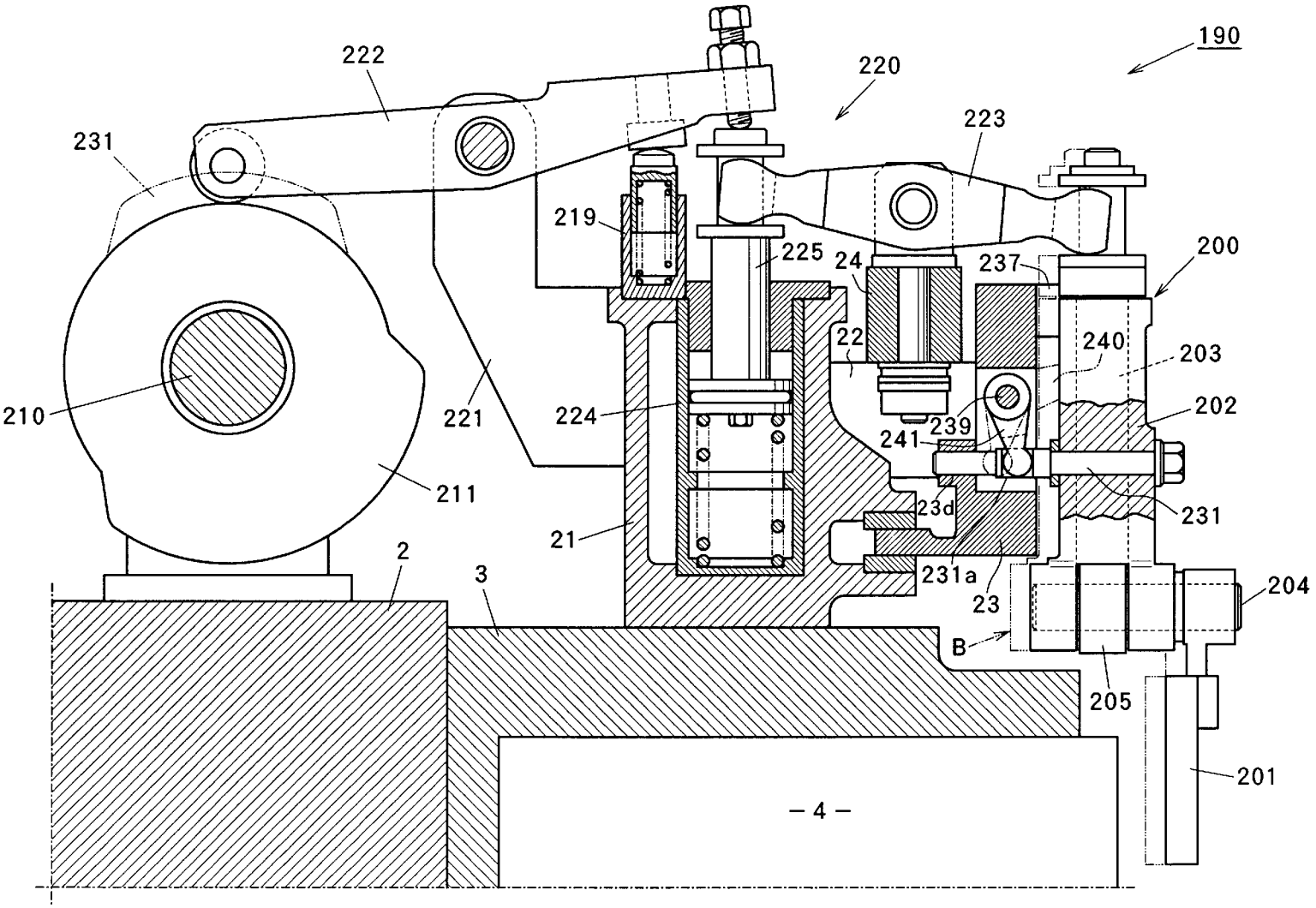
FIG. 13 is a cross sectional view taken in the direction of the arrows V—V in FIG. 12.
Figure 14:
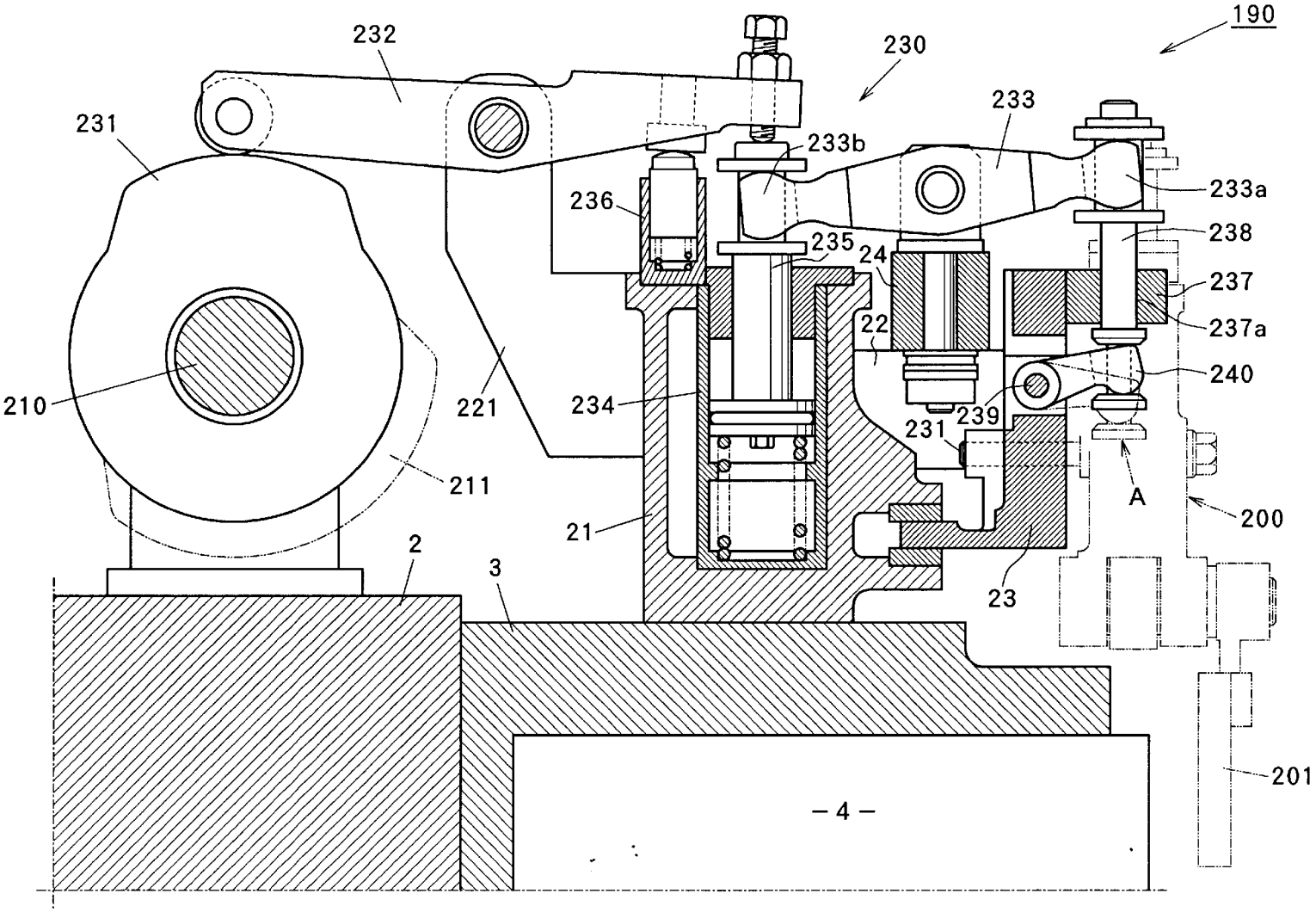
FIG. 14 is a cross sectional view taken in the direction of the arrows VI—VI in FIG. 12.

Alternatively, FIGS. 12 to 14 show still another embodiment of the invention, in which the same reference characters as those used in the above embodiments designate like or corresponding parts.

According to the work transfer 190 of this third embodiment, the chuck open-close mechanism 220 is quite similar to that of the first embodiment or second embodiment, i.e., as particularly shown in FIGS. 12 and 13, as a camshaft 210 behind the fixed frame 21 and a cam 211 secured to the camshaft 210 rotates synchronously with the forging motion of the ram 5, a cam arm 222 supported by a bracket 221 disposed to a rear face of the fixed frame 21 swings, and a piston rod 225 of a cylinder 224 installed in the fixed frame 21 moves upward (as shown in FIG. 13) and downward, whereby a rocker arm 223 disposed on a middle frame 24 swings, and a chuck axle 203 slidable in a chuck holder 202 of a chuck 200 ascends and descends (as shown in FIG. 13) to open and close finger members 201, 201 connected to pins 204, 204 via a pair of levers 205, 206 and a linking rod 207.

According to the third embodiment, on an upper surface of the fixed frame 21, adjacent to the cylinder 224, is mounted a biasing means 219 for assisting the piston rod 225 of the cylinder 224 in pushing up a front end portion of the cam arm 222 so that a rear end portion of the cam arm 222 contacts a profile of the cam 211 steadily.

On the other hand, the chuck approach-recede mechanism 230 is constituted as follows:

As shown in FIGS. 12 and 13, at either side of a midportion of the chuck holder 202 is fixed a guide rod 231, respectively, which extends through a guide hole 23*d* formed in the vertical wall of the movable frame 23. The guide rods 231, 231 pass through the respective guide holes 23*d*, 23*d* slidably, and thus, the chuck holder 202 or the chuck 200 is slidably supported to the movable frame 23 so as to be able to approach to and recede from a front face of the movable frame 23 with the result that the finger members 201, 201 approach to and recede from a front face of the die 4.

As particularly shown in FIG. 14, quite similar to the above-described chuck open-close mechanism 220, a cam 231 for the chuck approach-recede mechanism 230 is secured to the camshaft 210. The cams 231 . . . 231 for the chuck approach-recede mechanism 230 and the cams 211 . . . 211 for the chuck open-close mechanism 220 are aligned alternately on the camshaft 210.

The chuck approach-recede mechanism 230, quite similar to the above-described chuck open-close mechanism 220, includes a cam arm 232 swingably supported by the bracket 221, a rocker arm 233 rockably disposed on the middle frame 24, a cylinder 234 installed in the fixed frame 21, a piston rod 235 of which is always forced upward, and a biasing means 236 for assisting the piston rod 235 to push up a front end portion of the cam arm 232.

As shown in FIGS. 12 and 14, at an upper portion of the front face of the movable frame 23 is fixed a support member 237 having a vertical bore 237*a*, and a front end portion 233*a* of the rocker arm 233 is engaged with an upper portion of a slide rod 238 which slidably passes through the vertical bore 237*a* of the support member 237, while a rear end portion 233*b* of the rocker arm 233 is engaged with an upper portion of a piston rod 235.

Thus, as the camshaft 210 and the cam 231 rotates, the cam arm 232 swings, and the piston rod 235 of the cylinder 234 moves upward and downward (as shown in FIG. 14), whereby the rocker arm 233 swings, and the vertical slide rod 238 ascends (as shown in FIG. 14) and descends.

As particularly shown in FIG. 12, in the vertical wall of the movable frame 23 is rotatably supported an axle 239 extending horizontally in a range between the guide rods 231, 231 of the chuck holder 202 and the slide rod 238 of the chuck approach-recede mechanism 230, and to one end of the horizontal axle 239 is secured an input lever 240, which is, as also shown in FIG. 14, engaged with a lower portion of the vertical slide rod 238. The horizontal axle 239 is further provided with output levers 241, 241 secured thereto, each of which is, as also shown in FIG. 13, engaged with a recess it 231*a* formed at a midportion of corresponding guide rod 231, respectively. Both the input lever 240 and the output levers 241, 241 are engaged with the slide rod 238 and the guide rods 231, 231 with two-forked round heads thereof. In this case, the input lever 240 and output levers 241, 241 are preferably so arranged on the horizontal axle 239 that an axis of the input lever 240 extending from a center of the horizontal axle 239 to the engaging point with the slide rod 238 and an axis of the output levers 241, 241 extending from the center of the horizontal axle 239 to the engaging point with the guide rods 231, 231 make 90 degrees.

A profile of the cams 231 for the chuck approach-recede mechanism 230 disposed on the camshaft 210 is formed completely independent from a profile of the cams 211 for the chuck open-close mechanism 220 in such a manner that from a time that the work is grasped by the finger members 201, 201 to a time that the work is transferred to the next die of the downstream forging station, the vertical slide rod 238 is pulled up, and at a time that the work is transferred to the next die of the downstream forging station, the vertical slide rod 238 is pushed down.

Thus, as the slide rod 238 ascends (as shown in FIG. 14), the head of the input lever 240 goes up, and the horizontal axle 239 so rotates that the heads of the output levers 241, 241 go near to the front face of the movable frame 23 (as shown in FIG. 13), whereby the guide rods 231, 231 are pushed forward relative to the movable frame 23, and the chuck 200 is driven to recede from the front face of the movable frame 23.

On the contrary, as the slide rod 238 descends (as designated by a character A shown in FIG. 14), the head of the input lever 240 goes down, and the horizontal axle 239 so rotates that the heads of the output levers 241, 241 go near to a rear face of the movable frame 23, whereby the guide rods 231, 231 are withdrawn backward relative to the movable frame 23, and the chuck 200 is driven to approach to the front face of the movable frame 23 (as designated by a character B shown in FIG. 13).

In this third embodiment, the output levers 241, 241 move the chuck 200 both forward and backward relative to the movable frame 23 owing to the exact engagement of the head of the output levers 241, 241 and the recesses 231*a*, 231*a* of the guide rods 231, 231. Alternatively, the output levers 241, 241 may move the chuck 200 either forward or backward relative to the movable frame 23, and spring may be provided for moving the chuck 200 to return.

As this invention may be embodied in several forms without departing from the spirit of essential characteristics thereof, the present embodiment is therefore illustrative and not restrictive, since the scope of the invention is defined by the appended claims rather than by the description preceding them, and all the changes that fall within metes and bounds of the claims, or equivalence of such metes and bounds thereof are therefore intended to be embraced by the claims.

What is claimed is:

1. A work transfer in a multi-stage forging apparatus having a plurality of dies aligned on a die bank of a base frame, a plurality of punches disposed on a front face of a ram moved toward and away from the die bank as a forging motion, a movable frame which is supported by the base frame and reciprocates in a direction in which the dies are aligned synchronizing with the forging motion of the ram, and a plurality of chucks which are supported by the movable frame and reciprocate between the adjacent dies so as to successively transfer works from upstream dies to downstream dies, said chuck having a pair of finger members, and said chuck being supported by the movable frame able to move relative to a front face of the movable frame so that said pair of finger members approaches and recedes from a front face of the die, the work transfer comprising:

a camshaft rotating synchronously with the forging motion of the ram;

a chuck open-close mechanism for opening and closing the finger members of the chuck according to a rotation of said camshaft;

a push rod slidably supported by the movable frame for moving with said chuck, a sliding direction of said push rod being perpendicular to a direction in which the movable frame elongates; and an associate transmission mechanism for moving said push rod in said sliding direction according to the rotation of said camshaft;

and said camshaft being so constructed that from a time that said finger members close to grasp the work to a time that said finger members complete the transfer of the work to the downstream die, said push rod is so moved as said finger members recede from the front face of the die, and at a time that said finger members complete the transfer of the work to the downstream die, said push rod is so moved as said finger members approach the front face of the die.

2. A work transfer in a multi-stage forging apparatus having a plurality of dies aligned on a die bank of a base frame, a plurality of punches disposed on a front face of a ram moved toward and away from the die bank as a forging motion, a movable frame which is supported by the base frame and reciprocates in a direction in which the dies are aligned synchronizing with the forging motion of the ram, and a plurality of chucks which are supported by the movable frame and reciprocate between the adjacent dies so as to successively transfer works from upstream dies to downstream dies, said chuck having a pair of finger members, and said chuck being supported by the movable frame able to move relative to a front face of the movable frame so that said pair of finger members approaches and recedes from a front face of the die, the work transfer comprising:

a camshaft rotating synchronously with the forging motion of the ram;

a chuck open-close mechanism for opening and closing the finger members of the chuck according to a rotation of said camshaft;

a cylinder and piston supported by the movable frame for moving said chuck so that said chuck approaches and recedes from the front face of the movable frame; and a controlling means for controlling said cylinder so that from a time that said finger members close to grasp the work to a time that said finger members complete the transfer of the work to the downstream die, the piston of said cylinder expands as said finger member recede from the front face of the die, and at a time that said finger members complete the transfer of the work to the downstream die, the piston of said cylinder contracts as said finger members approach the front face of the die.

3. An apparatus according to claim 1, including a spring supported by the movable frame and forcing said chuck toward the front face of the movable frame; and wherein the associate transmission mechanism moves said push rod in said sliding direction according to the rotation of said camshaft and the force applied by said spring.

* * * * *